US007112003B2

(12) United States Patent
Frison

(10) Patent No.: US 7,112,003 B2
(45) Date of Patent: Sep. 26, 2006

(54) COMBINED TOOTHBRUSH, TOOTHPASTE AND MOUTHWASH DEVICE

(76) Inventor: Edwin Frison, 1526 University Blvd. West Suite #214, Jacksonville, FL (US) 32217

( * ) Notice: Subject to any disclaimer, the term of this patent is extended or adjusted under 35 U.S.C. 154(b) by 0 days.

(21) Appl. No.: 11/018,617

(22) Filed: Dec. 21, 2004

(65) Prior Publication Data

US 2005/0135870 A1 Jun. 23, 2005

Related U.S. Application Data

(60) Provisional application No. 60/532,280, filed on Dec. 23, 2003.

(51) Int. Cl.
*B43K 5/06* (2006.01)
*A47L 13/22* (2006.01)
*A46B 11/04* (2006.01)

(52) U.S. Cl. ..... 401/272; 401/280; 401/176

(58) Field of Classification Search ..... 401/44, 401/272, 280, 290, 176, 179; 15/106, 110, 15/111

See application file for complete search history.

(56) References Cited

U.S. PATENT DOCUMENTS 1,364,188 A * 1/1921 Draenert ..... 401/192
2,813,290 A * 11/1957 Aschenbach ..... 401/184
3,417,762 A 12/1968 Hall
3,937,235 A * 2/1976 Broughton ..... 132/308
5,066,155 A 11/1991 English et al.
5,144,712 A 9/1992 Hansel et al.
5,323,795 A * 6/1994 Berens ..... 132/309
5,425,590 A 6/1995 Duty et al.
5,769,553 A * 6/1998 Chaudhri et al. ..... 401/195
5,909,977 A 6/1999 Kuo
5,980,145 A 11/1999 Griffith
6,142,694 A 11/2000 Rivlin et al.
6,213,663 B1 4/2001 Micaletti et al.
6,220,772 B1 4/2001 Taylor
6,685,375 B1 2/2004 Crocker

* cited by examiner

*Primary Examiner*—David J. Walczak

(57) ABSTRACT

A disposable toothbrush containing a small amount of toothpaste disposed within an internal cavity in the head of the toothbrush and a small amount of mouthwash disposed within an internal cavity in the grip of the toothbrush, where the toothpaste is expelled onto the bristles of the toothbrush by pressing the head onto the handle shaft, and where the mouthwash is accessed by removing the head from the handle. The toothbrush further includes a tooth pick connected to the handle assisting a user to further clean their teeth.

6 Claims, 4 Drawing Sheets

COMBINED TOOTHBRUSH, TOOTHPASTE AND MOUTHWASH DEVICE

CROSS REFERENCE TO RELATED APPLICATIONS

This application claims the benefit of U.S. Provisional Application No. 60/532,280, filed Dec. 23, 2003.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates generally to the field of the toothbrushes for dental hygiene, and more particularly relates to toothbrushes that incorporate toothpaste and mouthwash in a single device.

2. Prior Art

Recommended dental hygiene includes brushing after every meal. In addition, especially after consuming certain foods or spices, rinsing with a mouthwash after the meal is often desirable. This practice is often considered to be impractical when meals are taken outside the home, as to do so requires bringing along a toothbrush, a tube of toothpaste and a bottle of mouthwash. Thus, many people do not bother to brush after meals eaten outside the home.

The object of this invention is to provide a dental hygiene device that encourages or makes simple the practice of tooth-brushing after meals taken outside the home. To this end, the dental hygiene device is a disposable toothbrush that incorporates a one-use amount of toothpaste and a one-use amount of mouthwash, such that the user can readily carry the device in a pocket, purse, briefcase, etc. in a clean hygienic manner, use the toothbrush when desired and then discard the toothbrush.

BRIEF SUMMARY OF THE INVENTION

In view of the foregoing background, it is therefore an object of the present invention to provide disposable toothbrush. These and other objects, features, and advantages of the invention are provided by a small supply of toothpaste and a small supply of mouthwash contained within a toothbrush.

The toothbrush includes a handle and a head member. The handle is adapted to be easily held in the user's hand and comprises a distal shaft portion, an intermediate portion and a proximal or grip end. The head member is disposed onto the distal shaft portion of the handle, with bristles mounted onto a lateral face of the head member. Preferably, all components are formed of a polymer or rubber material.

The grip end of the handle is provided with an internal cavity adapted to retain a small quantity, suitable for a single use, of liquid mouthwash or mouth rinse. The grip end of the handle is significantly larger in diameter than the distal shaft portion of the handle. Most preferably, the grip end is provided with grip members to reduce slippage of the toothbrush 10 during use.

Also, most preferably, the proximal end is provided with a flexible toothpick or gum massage member. Also most preferably, the grip end is provided with a transparent or translucent window portion that allows the mouthwash to be visible to the user throughout the window portion, in order to verify that a quantity of mouthwash is present in the toothbrush.

The intermediate portion of the handle is provided with a releasable connection means such that the distal shaft portion can be disconnected from the grip end to expose an opening to the grip cavity. Preferably, the releasable connection means comprises a mated coupling of an externally threaded member and an internally threaded member. Most preferably, the shaft portion is provided with grip members that provide for a better grip when the handle distal shaft portion is rotated relative to the handle grip end to expose the mouthwash opening.

An internal cavity is disposed within the head member in order to receive a small amount, preferably a one-time use amount of toothpaste. The distal shaft portion of the handle is inserted into through a shaft opening located in the proximal end of the head member. A plunger or ram member is disposed on the distal end of the distal shaft portion such that it resides within the head internal cavity.

One or more apertures are provided in the lateral face of the head member, adjacent the bristles. The head member is mounted onto the distal shaft portion of the handle in such a manner that allows for relative reciprocal or axial movement of the head member and handle, such that either the ram member of the handle may be forced further into the head internal cavity or the head member may be forced down onto the distal shaft portion of the handle. Such relative movement causes the ram member to expel or express the toothpaste resident within the head internal cavity through the apertures and onto the bristles, such that the toothbrush is ready for use.

After the tooth-brushing operation is completed, the head member and the distal shaft portion is removed from the grip end of the handle, such that the user can pour the mouthwash into the user's mouth. With the dental hygiene operation completed, the toothbrush is then discarded.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 3:
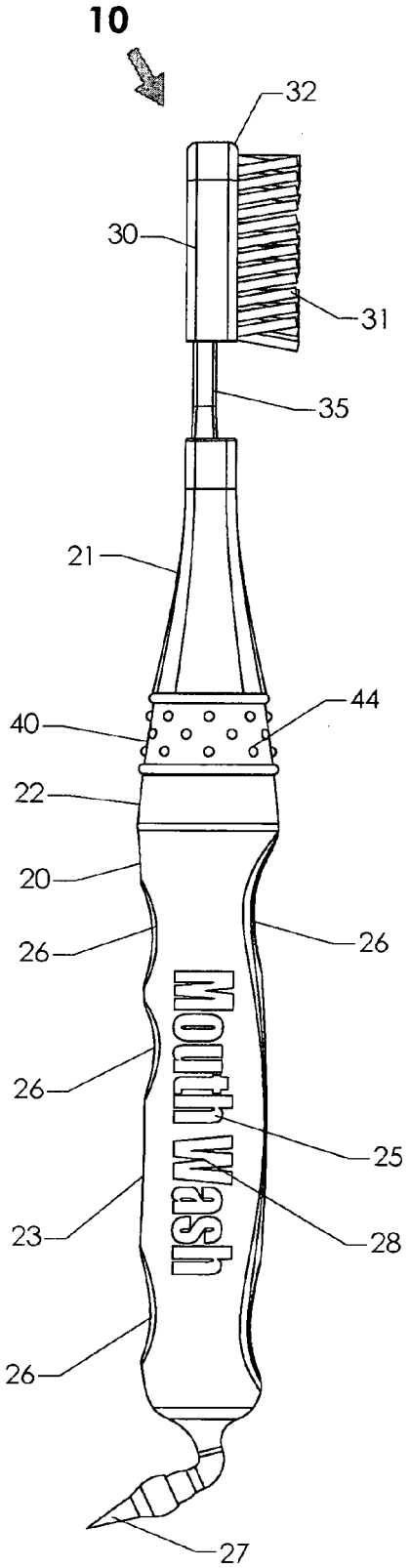
FIG. 3 is side elevational view showing the toothbrush of FIG. 1 at a non-operable position wherein the ram portion of the handle is not engaged with the head member thereof.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–10 by the reference numeral 10 and is intended to provide a disposable toothpaste that houses a predetermined quantity of mouthwash and toothpaste. It should be understood that the apparatus 10 may be employed by various individuals and can be altered to include many different types of mouthwash and toothpaste, as need by the user.

With reference to the drawings, the invention will now be described with regard for the best mode and the preferred embodiment. In general, the invention is a disposable toothbrush that retains internally a supply of toothpaste and a supply of mouthwash, such that the user may expel the toothpaste into the bristle area of the toothbrush in order to perform the tooth-brushing operation, can then access the mouthwash in order to perform the mouth rinsing operation, and can then dispose of the toothbrush.

Figure 1:
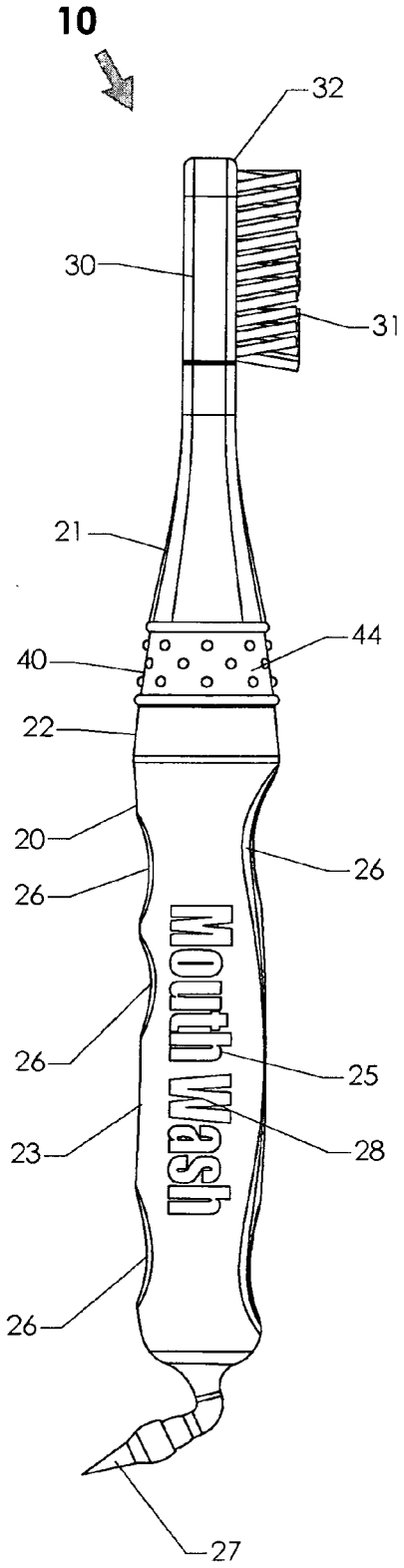
FIG. 1 is a side elevational view showing a disposable toothbrush adapted to an operable position, in accordance with the present invention.
Figure 4:
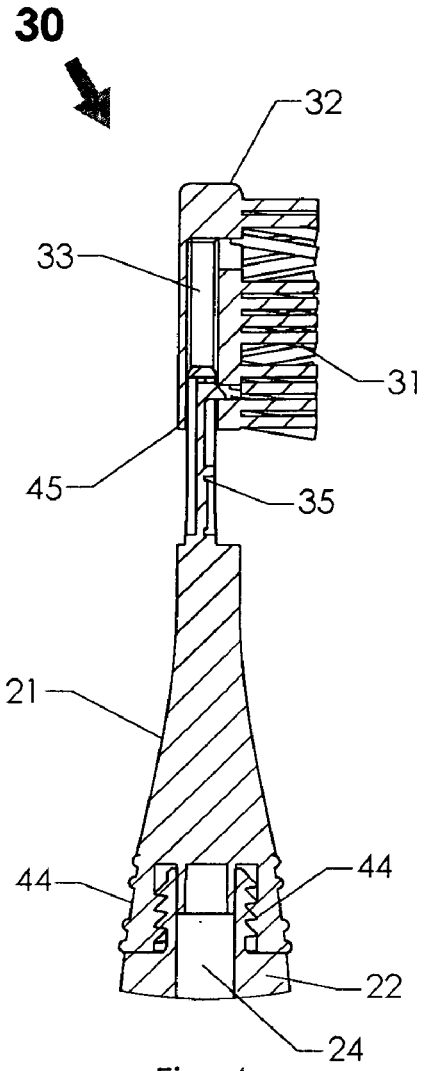
FIG. 4 is a partial cross-sectional view of the distal end of the toothbrush shown in FIG. 3, illustrating the ram portion of the handle at a disengaged position.
Figure 2:
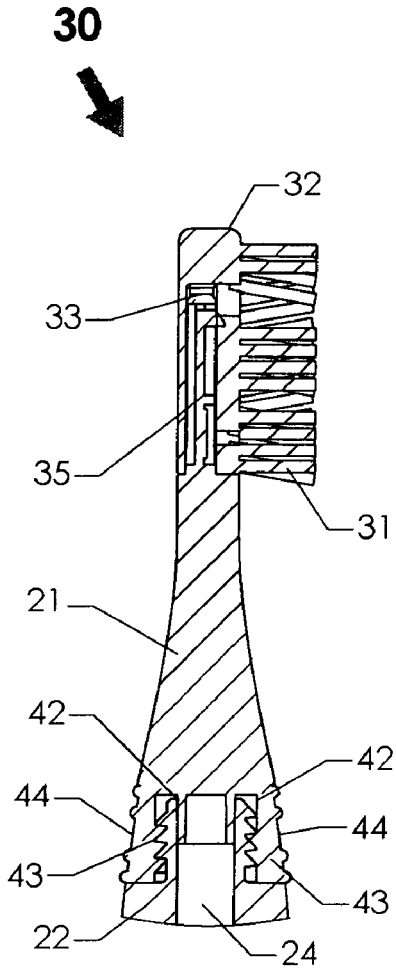
FIG. 2 is a partial cross-sectional view of the distal end of the toothbrush shown in FIG. 1, illustrating the ram portion of the handle.
Figure 5:
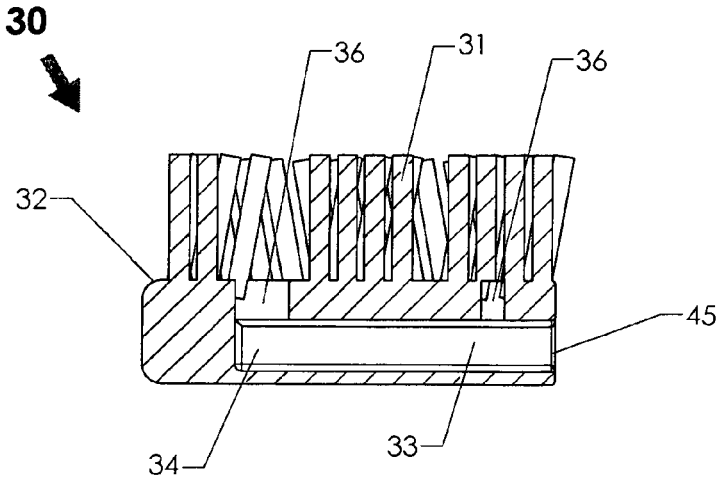
FIGS. 5–7 are enlarged side elevational, top plan and perspective views respectively showing the head cavity and notch for locking the handle in place when the toothbrush is adapted to an operable position.
Figure 6:
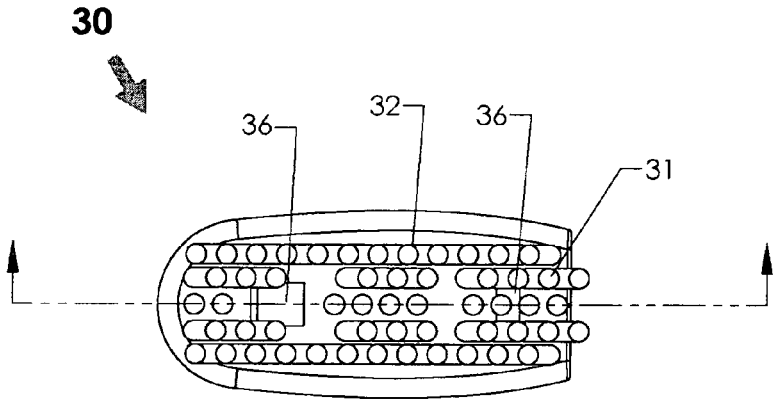
Figure 7:
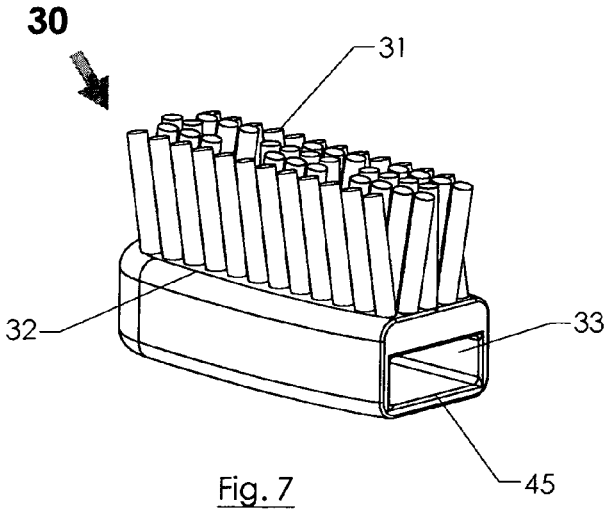
Figure 8:
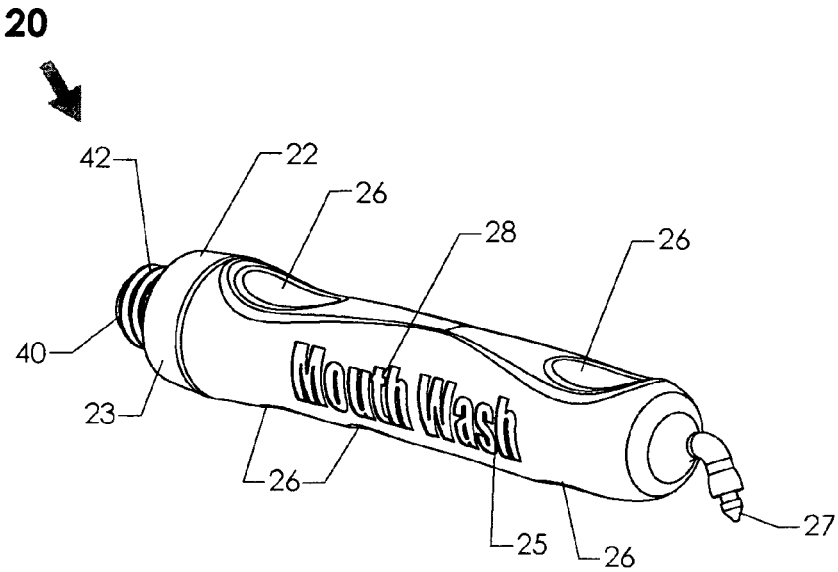
FIG. 8 is a perspective view of the transparent handle, which housing mouthwash and includes a pick the proximal end thereof.
Figure 9:
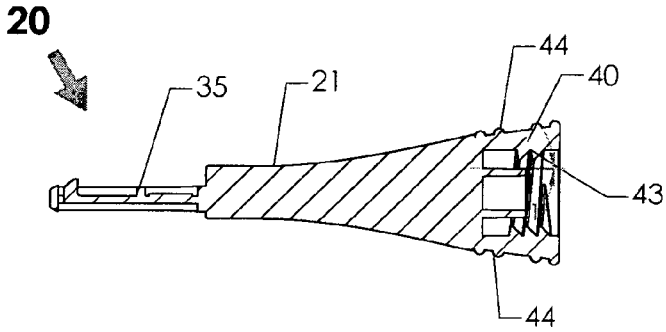
FIGS. 9–10 are side elevational and perspective views respectively showing partial portion
Figure 10:
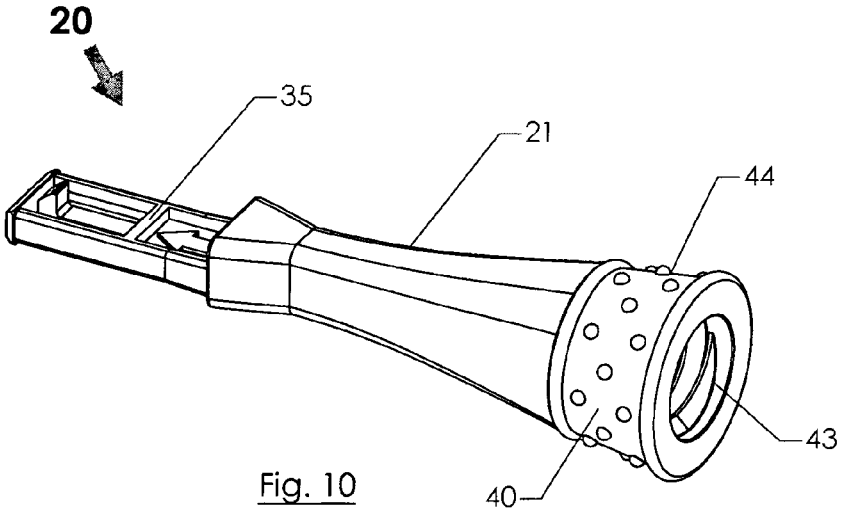

As seen in FIGS. 1 and 2, the invention is a toothbrush 10 including a handle 20 and a head member 30. The handle 20 is adapted to be easily held in the user's hand and comprises a distal shaft portion 21, an intermediate portion 22 and a proximal or grip end 23. The head member 30 is disposed onto the distal shaft portion 21 of the handle 20, with bristles 31 mounted onto a lateral face 32 of the head member 30. Preferably, all components are formed of a polymer or rubber material.

The grip end 23 of the handle 20 is provided with an internal cavity 24 adapted to retain a small quantity, suitable for a single use, of liquid mouthwash or mouth rinse 25. The grip end 23 of the handle 20 is significantly larger in diameter than the distal shaft portion 21 of the handle 20. Most preferably, the grip end 23 is provided with grip members 26 to reduce slippage of the toothbrush 10 during use.

Also, most preferably, the proximal end 23 is provided with a flexible toothpick or gum massage member 27. Also most preferably, the grip end 23 is provided with a transparent or translucent window portion 28 that allows the mouthwash 25 to be visible to the user throughout the window portion 28, in order to verify that a quantity of mouthwash 25 is present in the toothbrush 10.

The intermediate portion 22 of the handle 20 is provided with a releasable connection means 40 such that the distal shaft portion 21 can be disconnected from the grip end 23 to expose an opening to the grip cavity 24. Preferably, the releasable connection means 40 comprises a mated coupling of an externally threaded member 42 and an internally threaded member 43. Most preferably, the shaft portion 21 is provided with grip members 44 that provide for a better grip when the handle distal shaft portion 21 is rotated relative to the handle grip end 23 to expose the mouthwash opening 41.

An internal cavity 33 is disposed within the head member 30 in order to receive a small amount, preferably a one-time use amount of toothpaste 34. The distal shaft portion 21 of the handle 20 is inserted into through a shaft opening 45 located in the proximal end of the head member 30. A plunger or ram member 35 is disposed on the distal end of the distal shaft portion 21 such that it resides within the head internal cavity 33.

One or more apertures 36 are provided in the lateral face 32 of the head member, adjacent the bristles 31. The head member 30 is mounted onto the distal shaft portion 21 of the handle 20 in such a manner that allows for relative reciprocal or axial movement of the head member 30 and handle 20, such that either the ram member 35 of the handle 20 may be forced further into the head internal cavity 33 or the head member 30 may be forced down onto the distal shaft portion 21 of the handle 20. Such relative movement causes the ram member 35 to expel or express the toothpaste 34 resident within the head internal cavity 33 through the apertures 36 and onto the bristles 31, such that the toothbrush 10 is ready for use.

The head member 30 is spaced from the handle 20. The toothpaste dispensing means and the head member 30 are slidably and telescopically enpageable for dispensing the toothpaste 34 out of the head member 30. The head member cavity 33 is disposed directly adjacent to the bristles 31 wherein the head member cavity 33 lies contiguously along the bristles 31. The ram member 35 has a longitudinal length approximately equal to a longitudinal length of the head member cavity 33 because the present invention 10 only needs one dosage of toothpaste 34 for a one-time use.

After the tooth-brushing operation is completed, the head member 30 and the distal shaft portion 21 is removed from the grip end 23 of the handle, such that the user can pour the mouthwash 25 into the user's mouth. With the dental hygiene operation completed, the toothbrush 10 is then discarded.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

The invention claimed is:

1. A disposable toothbrush comprising:

a head member including a plurality of bristles mounted thereon;

a handle comprising a distal shaft portion removably connected to said head member, said head member cavity being disposed directly adjacent to said bristles wherein said head member cavity lies contiguously along said bristles; said handle being provided with a cavity adapted to retain a selected quantity of mouthwash, said head member further including at least one aperture formed therein adjacent said plurality of bristles;

said head member having a cavity defined therein for receiving a selected amount of toothpaste and further having a shaft opening located therein such that said distal shaft portion is insertable therethrough; and a ram member disposed on said distal shaft portion such that it resides within said head cavity, said ram member having a longitudinal length approximately equal to a longitudinal length of said head member cavity;

wherein said head member is mountable onto said distal shaft portion in such a manner that allows for substantially axial movement of said head member and said handle such that either said ram member may be forced further into said head cavity or said head member may be forced down onto said distal shaft portion, such axial movement for causing said ram member to expel toothpaste resident within said head cavity through said apertures and onto said bristles such that said toothbrush is ready for use.

2. The disposable toothbrush of claim 1, wherein said handle and said head portion are formed of a polymer material.

3. The disposable toothbrush of claim 1, wherein said distal shaft end is provided with a plurality of grip members to reduce slippage of said toothbrush during use.

4. The disposable toothbrush of claim 1, further comprising: a releasable connection mechanism comprises:

a externally threaded member and an internally threaded member removably coupled thereto.

5. The disposable toothbrush of claim 1, wherein said handle further comprising: a proximal grip end portion provided with a transparent window portion That allows mouthwash to be visible to the user throughout said window portion in order to verify that a quantity of mouthwash is present in said toothbrush.

6. The disposable toothbrush of claim 1, further comprising: a toothpick attached to said handle.

* * * * *